United States Patent [19]

Zeski

[11] 4,306,327

[45] Dec. 22, 1981

[54] TOOTHBRUSH

[76] Inventor: Stephen J. Zeski, 1009 Broadway, Rockford, Ill. 61104

[21] Appl. No.: 37,277

[22] Filed: May 9, 1979

Related U.S. Application Data

[63] Continuation-in-part of Ser. No. 682,447, May 3, 1976, abandoned.

[51] Int. Cl.[3] ..... A46B 9/04

[52] U.S. Cl. ..... 15/167 R

[58] Field of Search ..... 15/167 R, 167 A, 110, 15/172, 176; D4/21–28

[56] References Cited

U.S. PATENT DOCUMENTS

| | | | |
|---|---|---|---|
| D. 58,445 | 7/1921 | Marcellus | D4/25 |
| D. 107,228 | 11/1937 | Goodman | D4/25 |
| D. 136,463 | 10/1943 | Robinson | 15/167 R |
| D. 213,540 | 3/1969 | Razickas | D4/25 |
| D. 240,677 | 7/1976 | Thompson | D4/25 |
| 1,682,325 | 8/1928 | D'Amico et al. | 15/176 |
| 1,929,530 | 10/1933 | Abelson | 15/167 R |
| 2,845,649 | 8/1958 | Hutson | 15/167 R |
| 3,868,742 | 3/1975 | Brenner | 15/167 R |
| 4,109,339 | 8/1978 | Dietrich | 15/167 R |

FOREIGN PATENT DOCUMENTS 435355 10/1926 Fed. Rep. of Germany .

*Primary Examiner*—Edward L. Roberts

*Attorney, Agent, or Firm*—Sixbey, Friedman & Leedom

[57] ABSTRACT

A toothbrush having an elongated handle portion and an integral head portion which is elongated but normally shorter than the handle portion with both portions being substantially flat and lying in a common plane. The head portion includes an elongated shaft which extends from a juncture with the handle portion to a terminal bristle support section; the length of said head portion being sufficient to permit the bristle support section to reach the molars of a user when the juncture between the head and handle portions is positioned adjacent the lip of the user. A plurality of bristles are fixed to the bristle support section of the head portion and project therefrom in a direction generally perpendicular to said common plane. The axis of said head portion is disposed at an acute angle relative to the axis of the handle portion, and the bristles extend in the direction of the axis of the head portion. The acute angle is in the range of from five to thirty degrees and, in the preferred form, is approximately fifteen degrees.

1 Claim, 2 Drawing Figures

TOOTHBRUSH

This application is a continuation-in-part of Ser. No. 682,447 filed May 3, 1976, now abandoned.

BACKGROUND OF THE INVENTION

Toothbrushes known to the prior art generally include a head portion and a handle portion with a common, straight line longitudinal axis. It is extremely difficult to use these straight toothbrushes to effectively clean the molars and massage the gums at the back of a user's mouth or to clean the inner sides of the teeth throughout the mouth. When a straight toothbrush is held normally in a human hand, the longitudinal axis of the brush lies at an angle approaching the vertical when the forearm of the user is horizontal. To move the longitudinal axis of the brush to a horizontal brushing position, for reaching the molars of the user, it is necessary for the wrist to pivot downwardly until the brush axis is horizontal, and then the wrist must be pivoted about a vertical axis to bring the head portion of the brush to the angle necessary to reach the molars. With the wrist in this awkward position, it is virtually impossible to manipulate the toothbrush effectively to clean the molars and massage the gums at the rear of a user's mouth.

As an alternative to wrist manipulation, most users of straight toothbrushes raise the elbow to substantially mouth level so that the brush may reach the molars. This position discourages effective brushing, as arm fatigue tends to cut short the brushing period.

Straight toothbrushes become extremely awkward when used to clean the inner surfaces of the teeth. When the toothbrush is inserted vertically from above to reach the inner surfaces of the lower incisors, the user's nose presents an obstacle to effective brushing.

To clean the rear surfaces of the molars with a straight toothbrush is extremely difficult, as the brush handle tends to contact the incisors, thus preventing the brush from reaching all rear surfaces of the molars.

In an attempt to overcome the difficulties experienced with straight toothbrushes, various angled toothbrushes have been developed to enhance the effectiveness of a toothbrushing operation. Although these angled toothbrushes have alleviated to some extent the deficiencies of straight toothbrushes, they have not been properly dimensioned or structured to be completely effective.

For example, a major structural deficiency of the known angled toothbrushes is that the brush portion is angled at a point very close to the juncture with the hand held handle portion. This requires that both the straight and angled portions of the toothbrush be inserted into the mouth to reach the rear molars, thereby increasing the awkwardness experienced in cleaning these molars. For effective operation, applicant has found that the apex of the angle between the handle and brush portions of the toothbrush should preferably remain outwardly of a user's lips during all brushing operations and should never be required to be inserted substantially within the mouth where it can contact the teeth, gums or walls of the oral cavity to inhibit movement of the brush. If this apex at the juncture between the handle and brush portions can be used as a fulcrum in the area of a user's lips for the internal movement of the brush section, the teeth may be cleaned with greater efficiency and ease.

Previously known angled toothbrushes do not take into account the very limited working areas available within the oral cavity and consequently do not provide a connecting stem between the brush and handle which is significantly reduced in size to provide ease in positioning and moving the brush. It is extremely beneficial to have the wide handle portion of the toothbrush remain externally of the oral cavity, to have the brush capable of reaching the rear molars without requiring extreme wrist and arm manipulation, and to have the brush and handle portions joined by an elongated stem of minimal width to enhance the maneuverability of the brush.

Some attempts have been made to develop angled toothbrushes with a head section which is pivotal relative to a handle section. Not only are such brushes difficult to clean, but additionally it is necessary to minimize the distance between the pivot point and the brush to prevent undesirable pivoting of the brush. The leverage action provided by a long connecting stem exerts forces on the pivot during a brushing operation which tend to cause pivoting of the head relative to the handle.

Finally, some angled toothbrushes have been developed wherein the axis of the head portion of the brush lies in a plane which is different from the plane of the handle portion of the brush. Toothbrushes of this type do not avoid the deficiencies of straight toothbrushes, for in fact the handle and head portions of these brushes lie along a straight line. In fact, these brushes require more space within the oral cavity for the accomplishment of a brushing operation than do straight toothbrushes.

SUMMARY OF THE INVENTION

The general object of the invention is to provide a new and improved toothbrush in which the handle portion and the head portion are a unitary structure and are disposed at a novel angular relation to each other so as to produce a better cleaning action without appreciably increasing the cost of the brush.

A more detailed object is to construct the toothbrush so that the handle and head portions are substantially flat and in a common plane and the longitudinal axis of the head portion is disposed at an acute angle relative to the axis of the handle portion so that the bristles on the head portion more readily reach the molar and the premolar teeth and the surrounding gum areas while the handle portion increases the effectiveness of the brushing action due to its tendency not to contact the incisor teeth.

Another object of the invention is to provide a novel and improved toothbrush having a brush support section which is joined to a handle portion by an elongated stem of reduced cross section relative to said handle portion and support section, said stem and brush support section being of sufficient length to reach the rearmost molars while permitting the juncture between the stem and handle portion to be positioned adjacent or at the entry to a user's mouth.

The invention also resides in the range of the acute angles between the longitudinal axes of the handle and head portions and, in its more detailed aspect, the particular acute angle.

DETAILED DESCRIPTION OF THE PREFERRED EMBODIMENT

Figure 1:
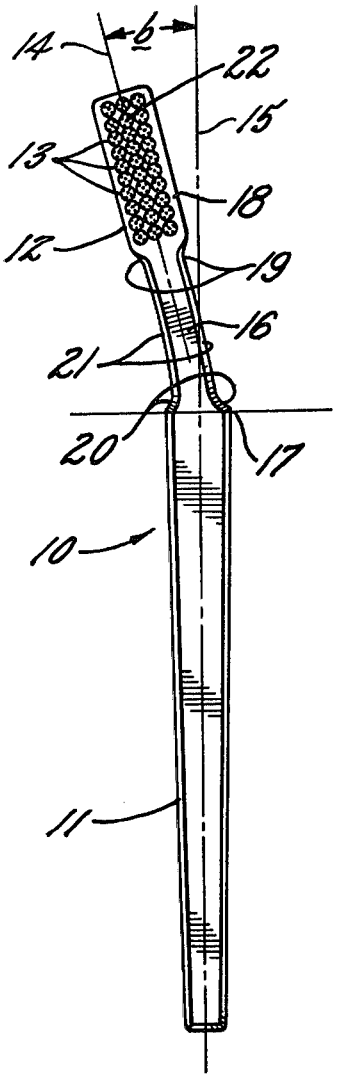
FIG. 1 is a front view of a toothbrush embodying the novel features of my present invention.

As shown in the drawings for purposes of illustration, the invention is shown as embodied in a toothbrush 10 comprising a generally elongated handle portion 11 and a substantially shorter but elongated head portion 12 which also is generally flat and is fixed to the handle portion. The handle and head portions are formed integrally and may be made as a single molded piece of plastic. As is customary in toothbrushes, a plurality of brushing bristles 13 project perpendicularly from at least a part of the head portion 12.

In accordance with the basic concepts of the present invention, the head portion 12 and the handle portion 11 are disposed relative to each other in a novel angular relationship so as to improve the brushing action of the molar and premolar teeth without hindering that brushing action by the handle portion contacting the incisor teeth or by causing discomfort to the cheeks and gums. To this end, the handle portion and the head portion lie in a common plane a (FIG. 2) and the longitudinal axis 14 of the head portion is disposed at an acute angle b (FIG. 1) relative to the longitudinal axis 15 of the handle portion, the angle being in the common plane and being within the range of five to thirty degrees.

Although the particular angle b within the range specified above will vary from person to person for optimum results, it has been found that an angle of approximately fifteen degrees is suitable for most persons. As shown in the drawings, the head portion 12 is bent to the left as viewed from the bristle side and this usually is more convenient for a right-handed person. The head portion may, however, be bent in the opposite direction (to the right as viewed in FIG. 1) and this normally will be more suitable for a left-handed person.

The head portion 12 includes a shaft or stem 16 which extends from a juncture with the handle 11, said juncture being indicated by a line 17. The outermost end of the shaft 16 is connected to a bristle support section 18 from which the bristles 13 project. The combined length of the shaft 16 and the bristle support section 18 should be such that the bristles 13 are permitted to reach the rear molars of a user with the juncture 17 positioned at a point on or slightly outward of the lips of the user. It should not be normally necessary for the juncture 17 to substantially enter the mouth of a user in order for the bristles 13 to contact the rearmost surfaces of the molars.

In a normal adult, the distance between the corner of the mouth and the rear molars may generally be in a range of from $1\frac{1}{2}$ to 2 inches. Consequently, if the distance from the juncture 17 to the outermost end of the bristle support section 18 is two inches, the head portion 12 will function properly for most adults and children. Obviously, brushes with reduced dimensions can be constructed using the same design for children.

It is important to form the shaft 16 to an appreciable length, for it is the purpose of this shaft to permit the bristles 13 to reach the innermost extent of the mouth while facilitating free movement of the head portion 12 about the fulcrum provided at the juncture 17. Consequently, the shaft 16 should ideally be at least one half the length of the total length of the head portion 12, and in some instances the shaft can be longer.

It is most desirable for the shaft 16 to be of reduced width relative to the handle 11 at the juncture 17, and generally the shaft will also be of reduced width relative to the width of the bristle support section 18. This permits the shaft to position the bristles 13 at the rear of a user's mouth while facilitating free movement of the bristles and bristle support section. The shaft 16 will completely clear the incisors and premolars during brushing of the molars and will slide easily between the upper and lower lips of the user. At either end, the shaft 16 tapers outwardly on both sides to the width of the handle and the bristle support section so that no pointed or abrupt edges are engaged by the lips of the user. Thus outwardly tapering edges 19 are provided on both sides of the shaft at the juncture with the bristle support section 18 and similar outwardly tapering edges 20 are provided on each side of the shaft at the juncture 17. Additionally, all four side edges of the shaft are preferably bevelled or rounded as indicated at 21.

The width of the shaft 16 should be as small as possible, but should not be so small that the toothbrush 10 is substantially weakened. Generally, the width of the shaft should be between one third and three fourths of the width of the handle 11 at the juncture 17.

Figure 2:
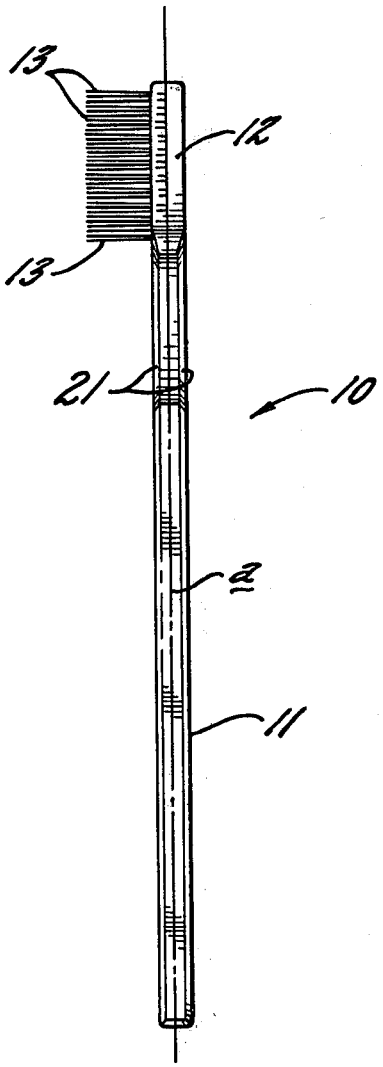
FIG. 2 is a side view of the toothbrush as seen from the right of FIG. 1.

It will be noted in FIG. 1 that the bristles 13 are arranged in rows with a center row of bristles 22 extending along the axis 14. One or more rows of bristles may be formed on either side of the center row 22, but all rows extend substantially parallel to the axis 14.

The angle b is formed at the juncture 17, and thus is spaced from the bristles 13 by the substantial length of the shaft 16. Thus a relatively small movement of the handle 11 to the right and left in FIG. 1 will pivot the head portion 12 about the fulcrum at the juncture 17 and, due to the length of the shaft 16, cause the bristles 13 to sweep across the rear molars between the upper and lower gums.

When the toothbrush 10 is held vertically to brush the inner surfaces of the lower incisors, the angle b insures that movement of the brush handle 11 will not be impeded by the nose of the user. When the handle 11 is held horizontally, the angle b and the reduced width of the shaft 16 permit the bristles to contact and clean the inner surfaces of the molars and premolars without contact between the shaft and the incisors.

The angle b should be formed as illustrated in FIG. 1 by gently curving the shaft 16 to the left (or right) from the juncture 17. This prevents the formation of sharp corners to irritate the mouth and lips of the user. In use, the shaft 16 and possibly the inclined surfaces 19 and 20 will be the only portions of the toothbrush 10 which contact the user's lips. The extent of the movement of the bristle support section 18 into and out of the oral cavity will be determined by the movement of the elongated shaft 16 sliding between the lips of the user.

In addition to the dimensions previously discussed, in most toothbrushes constructed in accordance with the invention the combined length of the shaft 16 and bristle support section 18 is approximately one third of the overall length of the toothbrush 10 and on half the length of the handle portion 11. Also, the width of the shaft is ideally about one half the width of the handle portion at the juncture 17.

With a toothbrush constructed in accordance with the invention as described above, it is easier to reach comparatively inaccessible areas of the molar and premolar teeth. Further, it is possible to obtain a better brushing action of the portions of the gums in the areas of these teeth. Moreover, this is achieved without discomfort to the cheeks of the user.

I claim:

1. A toothbrush formed to slide across and pivot on the lips of a user while cleaning the remote surfaces of the user's molars, pre-molars and incisors, said toothbrush comprising an elongated handle portion and an elongated head means integrally joined at an acute angle to said elongated handle portion in substantially co-planar relationship therewith, said acute angle being within the range of from 5° to 30° relative to the longitudinal axis of said elongated handle portion, said elongated head means including a bristle support section having a plurality of bristles projecting therefrom and an elongated neck means extending at said acute angle from a juncture on said elongated handle portion to connect with said bristle support section, said elongated neck means having a length equal to at least one half the length of said elongated head means to permit said juncture to be positioned adjacent the lips of the user when the terminal end portion of said bristle support section is positioned adjacent the innermost end of the user's innermost molar, said juncture thereafter providing a fulcrum about which said toothbrush may be pivoted on the user's lips to increase the leverage applied to said terminal end portion of said bristle support section during the tooth cleaning operation, said elongated neck means also having a reduced width within the range of from $\frac{1}{3}$ to $\frac{3}{4}$ the width of said elongated handle portion at said juncture while simultaneously curving away from said juncture in a gradual arc which terminates in said acute angle to permit said toothbrush to slide back and forth across the user's lips without contacting the incisors of the user whenever said bristle support section is positioned adjacent the outer or inner surfaces of the user's innermost molars, said bristle support section and said elongated handle portion at said juncture having substantially equal widths such that the sides of said elongated neck means connecting said elongated handle portion to said bristle support section curve outwardly at both ends of said elongated neck means to form tapered sidewalls which extend between the sides of said elongated handle portion and said bristle support section and the sides of said elongated neck means to eliminate any laterally extending sharp edges on said elongated head means, the outer extremities of the top, bottom, and side surfaces of said elongated neck means being further rounded to eliminate any longitudinally extending sharp edges on said elongated head means.

* * * * *